United States Patent [19]

Mino et al.

[11] 4,443,501

[45] Apr. 17, 1984

[54] METHOD FOR FORMING MINIMIZED SPANGLE COATED STRIP

[75] Inventors: George M. Mino, Hamburg; Donald L. Dustin, Elma; John H. Williams, Eden, all of N.Y.

[73] Assignee: Bethlehem Steel Corp., Bethlehem, Pa.

[21] Appl. No.: 353,716

[22] Filed: Mar. 1, 1982

[51] Int. Cl.[3] ..... B05D 3/12

[52] U.S. Cl. ..... 427/360; 427/398.2; 427/398.3; 427/433; 427/436

[58] Field of Search ..... 427/360, 433, 436, 398.2, 427/398.3; 118/101, 112, 117

[56] References Cited

U.S. PATENT DOCUMENTS

| | | | |
|---|---|---|---|
| 2,926,103 | 2/1960 | Brick | 427/360 |
| 3,323,940 | 6/1967 | Sievert | 427/360 |
| 3,608,520 | 9/1971 | Caldwell et al. | 118/117 |
| 3,698,938 | 10/1972 | Mayhew | 427/360 |
| 3,717,501 | 2/1973 | Caldwell et al. | 427/398.2 |

*Primary Examiner*—Michael R. Lusignan
*Assistant Examiner*—Janyce A. Bell
*Attorney, Agent, or Firm*—John I. Iverson; William B. Noll

[57] ABSTRACT

Molten zinc coated strip is contacted with an internally cooled roll upon which is provided a thin film of liquid that serves to maintain effective heat transfer contact between the surface of the roll and the surface of the strip across the entire face of the strip.

5 Claims, 3 Drawing Figures

METHOD FOR FORMING MINIMIZED SPANGLE COATED STRIP

CROSS REFERENCE TO RELATED APPLICATIONS

This application describes an invention which is an improvement of the invention shown and described in U.S. Pat. Nos. 3,608,520 and 3,717,501 to Lawrence B. Caldwell and Robert W. Helman assigned to the assignee of the present Application.

BACKGROUND OF THE INVENTION

This invention relates to molten metal coatings and particularly to the attainment of a so-called minimized spangle surface upon a hot dip galvanized coating.

As discussed in U.S. Pat. Nos. 3,608,520 and 3,717,501 listed above there have been a number of processes suggested for treatment of molten zinc surfaces on sheet and strip passing from a molten zinc bath in order to accellerate crystallization of the surface of the coating and obtain very small crystals or spangles on the surface of such coating. Molten coating surfaces on such sheets have in the past been contacted with water sprays, steam blasts, zinc powder or other crystallization nucleating substances blown onto the surface, and cooled rolls contacting the surface just prior to solidification in order to enhance nucleation. All of these expedients have had certain drawbacks. The internally cooled roll arrangement has the particular advantage of being cleaner and less troublesome than other nucleating processes. For example, water sprays or steam jets applied to the coating cause extremely humid conditions adjacent such sprays or jets often resulting in severe corrosion of the line apparatus.

The inventions of U.S. Pat. Nos. 3,608,520 and 3,717,501 were improvements of a previous invention disclosed in U.S. Pat. No. 1,933,401 to Ward wherein an internally cooled roll was used to enhance nucleation and smooth the coating while obtaining a minimized spangle without the disadvantages of other methods of nucleation. The '401 patent used a point contact of the cooling roll with the molten coated surface, while the '501 and '520 patents used an improved partial wrap-around arrangement of the strip or sheet upon unequal diameter offset cooled rolls. Although the surface of the minimized spangle rolls of the '520 and '501 patents was made very smooth, however, and the sheet and strip was wrapped tightly about such rolls in order to obtain good contact and heat conduction for a suitable period to obtain rapid cooling of the molten zinc surface, it has been found that the minimized spangle obtained is frequently not suppressed completely or is nonuniform. Furthermore, in some cases, particularly in the vicinity of scratches, welts, dross particles on the surface of the coating, or dents in the base metal, the usual spangle appears in the area about such blemishes.

SUMMARY OF THE INVENTION

The present inventors have discovered that spangling occurs in the area adjacent to defects on the sheets surface due to inadequate chilling in these areas because contact between the surface of the chilled roll and the surface of the sheet or strip is often insufficient or incomplete in such areas. It has also been discovered that poor suppression of spangle in other areas not adjacent to defects is also due largely to incomplete or poor contact of the coated strip with the surface of the chilled roll. The inventors have now successfully overcome this problem by providing for a heat transfer liquid on the surface of the cooled roll. The heat transfer liquid, which may conveniently be water, fills in any gaps between the surface of the coating and the surface of the roll and provides excellent heat transfer between the coating surface and the surface of the roll. An even, uniform minimized spangle is thus attained over the entire surface of the sheet or strip. Furthermore, even though the heat transfer liquid such as water is corrosive if it contacts adjacent apparatus, it has been found that if the coolant is correctly handled corrosive conditions can be minimized. If the cooling liquid is carefully applied to the surface of the internally cooled rolls in a thin film without splashing or agitation, little liquid or vapor from the liquid will be distributed in the immediate environment and the corrosivity of the environment in which the coating apparatus is contained will not be significantly increased.

DESCRIPTION OF THE PREFERRED EMBODIMENT

Figure 1:
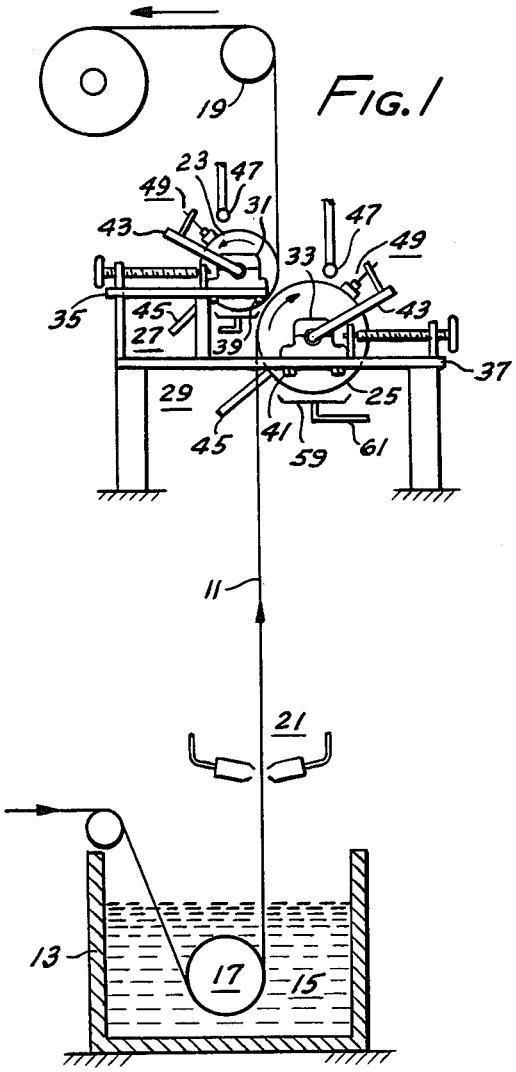
FIG. 1 is an elevation of a molten metal coating apparatus including the improvement according to the present invention.

In FIG. 1 a strip 11 is shown passing through a molten metal coating pot 13 filled with a bath 15 of molten zinc. The strip 11 passes around sinker roll 17 and then upwardly from the surface of the bath to a guide roll 19 and thence out of the apparatus. As strip 11 leaves the molten bath 15 it accumulates a heavy coating of molten zinc picked up in the bath. Within a short distance above the bath both sides of the strip are contacted with planar jets of high pressure steam or other gas from gas or jet wipers 21 positioned on both sides of the strip. The jet wipers 21 wipe excess coating from the surface of the strip and determine the thickness of the final coating. As is well understood in the art, if differential coating thicknesses are desired on the two sides of the strip the jet wipers will be adjusted to wipe more molten coating from one side of the strip than the other.

After passing between the jet wipers 21 the strip passes between two unequal sized rolls 23 and 25 of a minimized spangle apparatus 27 mounted approximately 20 feet above the surface of molten bath 15. Small roll 23 and large roll 25 are adjustably positioned for lateral movement upon supporting structure 29. The rolls 23 and 25 are journaled in bearing supports 31 and 33 respectively which are slidably engaged with slotted tracks 35 and 37 respectively by large screws 39 and 41. Cooling water is passed into the rolls through water access pipes 43 and out through discharge pipes 45. The cooling water is maintained at a temperature which will keep the surface of the cooling roll at a temperature which is sufficient to cause very accellerated cooling of the surface of the molten coating so that a large number of crystal nucleation centers are formed on the surface of the coating and the resulting metal crystals rapidly grow against each other. The large number of nucleation centers results in each metal crystal having a minimum space in which to grow and the resulting crystals and opposed crystal surfaces at the surface of the coating consequently are of very small size. This provides the minimized spangle surface sought. The cooling rolls 23 and 25 also smooth the surface of the coating further reducing evidence of any pronounced spangle effect on the surface.

In accordance with the present invention a heat transfer liquid, which for convenience is comprised of water, is applied to the surface of each cooling roll 23 and 25 in order to fill in any inequalities between the surface of the rolls and the coated surface on the sheet or strip passing by the rolls. The liquid completely fills any such inequalities or spaces so that there is effectively no clearance at all between the roll surface and the coating surface and the heat transfer contact is very precisely the same across the surface of the entire roll. When the heat transfer is the same at all positions of the roll surface the crystal growth at all points on the surface of the coating is substantially the same and the resulting spangle on the surface of the solidified coating is uniform over the entire sheet or strip surface.

In the embodiment of the invention shown in the Figures water is used as the heat transfer liquid and is applied to the roll surface via manifolds 47 which extend longitudinally across the tops of the cooling rolls 23 and 25. Preferably each manifold 47 is displaced approximately 15 to 30 degrees from the top of the roll in the direction in which the roll rotates. Each manifold has a series of small orifices or nipples 48 disposed along its lower side through which drops or small streams of water are allowed to fall upon the top of the rolls. The slight displacement of the manifold from the top of the roll to the side in the direction of roll rotation prevents the cooling liquid from running down the roll on the strip contact side of the roll against the rotational movement of the roll. The manifold is positioned as closely as practical to the surface of the roll to minimize the distance the water must fall to reach the roll surface. A close spacing minimizes splashing when the water contacts the roll surface. On the side of the rolls 23 or 25 toward which the rolls rotate there is disposed, approximately 40 to 50 degrees away from the location of the manifold 47 and extending completely across the surface of the roll, a spreader 49. The spreader 49 shown in the Figures comprises a foam rubber or plastic foam pad 51 having a metal backing 53. A support rod or rods 55 secured to the backing 53 are slidingly supported in a bracket 57 such that the pad 51 is continuously urged by its own weight against the surface of the cooling rolls.

The spreaders 49 serve to spread the heat exchange liquid in a thin, even film 58 over the surface of the rolls 23 and 25. This thin film of liquid should be of sufficient thinness so that it adheres to the surface of the rolls by surface tension and is carried around by rotation of the rolls until the strip or sheet passes onto the roll over the liquid film on the opposite side of the rolls. The film of heat transfer liquid fills in any inequalities between the surface of the roll and the coated surface and substantially completely equalizes heat transfer from the surface of the coated strip to the surface of the roll.

After the strip or sheet 11 has passed over the thin film 58 of heat transfer liquid and the strip or sheet 11 leaves the surface of the roll and passes upwardly over the guide roll 19 the remaining film of liquid passes again around the roll being renewed by additional liquid from the manifold 47 and again smoothed and distributed by the spreader 49. Any excess heat transfer liquid will drip into drip pans 59 disposed under the rolls 23 and 25 in a position to catch liquid dripping from the bottom of the rolls. A drain 61 leads any such drippings away from the area of the coating apparatus. Preferrably a valve 63 in the water line 65 feeding the manifold 47 serves to adjust the amount of liquid which is deposited upon the roll surface by the manifold 47. It has been found that the colder the heat transfer liquid is the better the minimized spangle which is obtained. Consequently, it may be desirable to include a refrigeration unit 67 in the feed line 65 to cool the heat transfer liquid prior to its passage to the manifold 47. A desirable temperature for the liquid if it is composed of water is about 35° F. to 40° F. (about 1.5° to 4.5° C.), however, any low temperature will be satisfactory. The temperature of the heat transfer liquid need not be the same as the nominal temperature at which the cooled roll is maintained, which temperature may be significantly higher than the above. See, for example, U.S. Pat. Nos. 3,608,520 and 3,717,501 which suggest the use of roll surface temperatures of between 130° and 200° F. (approximately 54° and 93° Celsius respectively). However, with the present invention it has been found that the roll surface may also be cooled to a lower temperature by internal cooling since the primary reason for the former difficulty in using the chilled rolls at lower temperatures was that condensation would form on the cold roll surfaces if too cold and this condensation would cause mottling of the coated surface. The thin film of cooling liquid and particularly water on the surface of the rolls eliminates any problem with condensation on the roll surfaces since any condensed moisture will merely merge with the liquid film.

Figure 2:
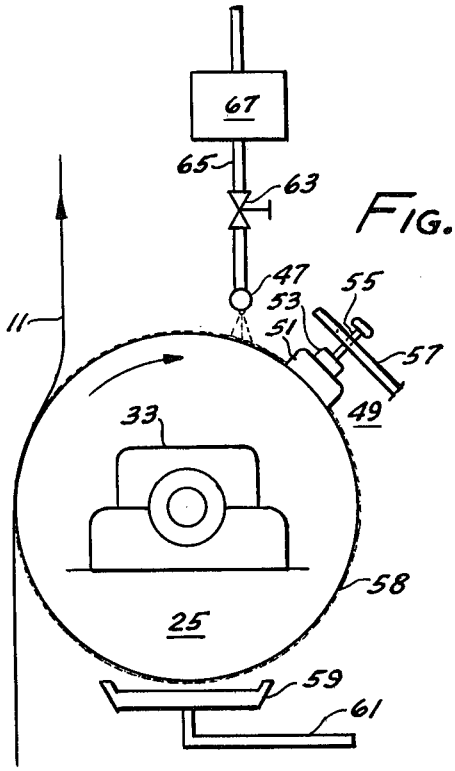
FIG. 2 is an enlarged end view and FIG. 3 is an enlarged longitudinal view of one of the internally cooled rolls of the invention showing the arrangement for applying a cooling liquid film to the surface of the roll and removing excess liquid.
Figure 3:
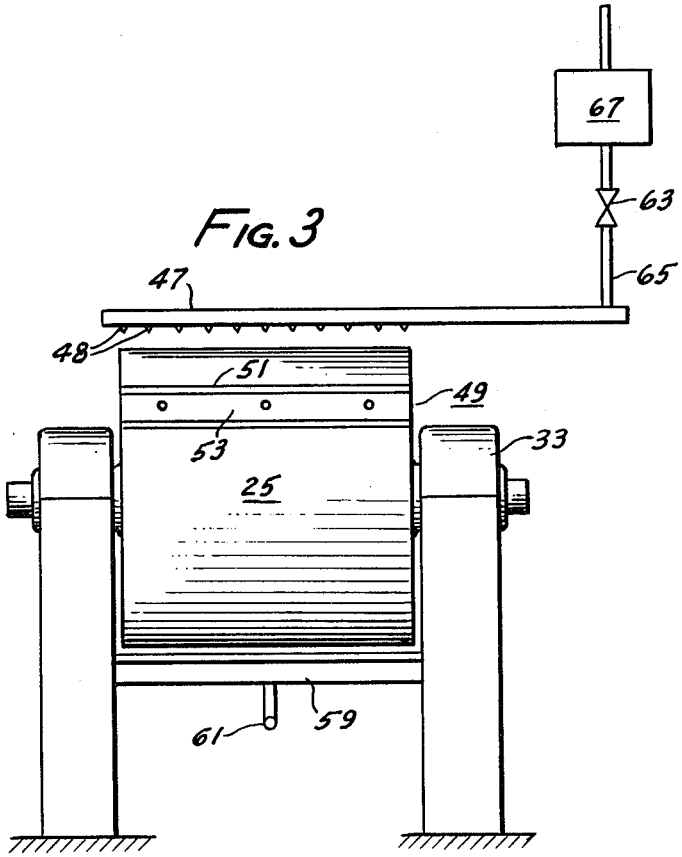

In some cases it may be desirable to locate the spreader 49 directly opposite the location shown in FIGS. 1 and 2 so that the heat transfer liquid is smoothed after it passes the drip pan 59 and just before the liquid contacts the under side of the sheet or strip 11. Alternatively, it may be desirable to use a second spreader in this alternative location. The advantage is that the film smoothness and thickness is adjusted just after it may have been disturbed by drainage of excess liquid into the drip pan 59. However, in most instances the film thickness is self adjusted by surface tension as quickly as any material falls from the bottom of the roll. On the other hand, if no spreader at all is used to spread the heat transfer liquid on the surface of the roll the liquid will become streaked and an uneven spangle will be obtained. If a spreader is used on the lower portion of the roll, it will be necessary to hold it against the roll surface by spring means or other equivalent means or by periodic manual adjustment since the pad will not be effectively held against the roll by gravity unless a counterbalance arrangement is used. Of course, other arrangements for urging the spreader 49 against the upper portion of the roll as shown could also be designed.

It has been found that a foam rubber or plastic foam spreader will last about a week at a rather insignificant cost. Harder and more durable wipers can be used, but tend not to provide an absolutely even film of heat transfer fluid. As pointed out above significant inequalities in the thickness of the film of heat transfer fluid tend to cause an uneven minimized spangle.

In order for the heat transfer from the surface of the strip or sheet to the cooled roll to be the same at all points, it is necessary for the molten coating to be substantially the same temperature at all points across the surface of the sheet as it approaches the cooling rolls. It is also necessary for the roll surface to have a substantially equal temperature across its face. In addition, the heat transfer liquid should have substantially the same temperature across the surface of the roll. These various conditions are not difficult to attain under the proper conditions. For example, the surface of the coated strip is normally at a fairly uniform temperature across its face as it approaches the cooled rolls. This is shown by the fact that the solidification line clearly evident across the sheet face is normally substantially even as the strip or sheet advances upwardly after leaving a molten coating bath, although the solidification line is usually somewhat higher in the center indicating a somewhat higher temperature near the center of the strip as the surface of the coating solidifies.

An even temperature across the surface of the cooling roll is attainable if good internal heat transfer is provided in such roll. An effective internal structure for such rolls is shown in the referred to U.S. Pat. Nos. 3,608,520 and 3,717,501. An even temperature in the heat transfer liquid is not difficult to attain if a constant flow of cooling liquid is maintained through the manifold 47.

It has been found that the use of the heat transfer liquid such as water has additional advantages besides providing a uniform transfer of heat from the surface of the cooling roll to the strip to be provided with a minimized spangle. In the prior use of cooled rolls it has often been the case that small particles of coating or of dross would stick to the roll surface. These particles would then pass around the roll as it rotated and cause a small indentation or imperfection every time they contacted the strip. It would be necessary, therefore, for the roll to be wiped or cleaned periodically to remove such particles. It has been found that with the use of the heat transfer liquid of the invention on the cooled rolls, particularly when water is used as the heat transfer liquid, neither particles of the coating nor dross particles adhere to the roll surface. In other words, the thin film of liquid acts as a lubricant or release agent to prevent sticking of the coating to the rolls.

It is important that a soft material such as plastic foam, for example, polyurethane foam, be used as a spreader so the constant contact of the spreader with the surface of the roll does not wear a slight groove in the surface of the roll. Such a groove would cause unequal spangling of the coating on the sheet material. Even fairly soft materials such as rags or the like has been found to tend to cause grooving of the roll surface. While the use of water as a heat exchange liquid has been shown and described herein and it is convenient to discharge water to waste, it will be understood that some other liquid which could be refrigerated could be used as a heat transfer fluid, and, if desired, could be recycled.

While the invention has been described with respect to the use of certain apparatus illustrated, it will be understood that the invention is broader than the particular apparatus shown and described. For example, while the use of the cooled rolls described in U.S. Pat. Nos. 3,608,520 and 3,717,501 has been described, and is preferred for best results, it will be understood that any other cooled rolls for minimizing spangle could be used and the particular effectiveness of such rolls in providing a uniform minimized spangle would be increased.

In particular, while it is very desirable to use the wrapped contact arrangement of the sheet or strip with the cooled rolls as shown in the referred to patents and illustrated in FIG. 1, a lesser amount of contact of the sheet or strip with the roll surface, even as little as the substantial line contact shown in the Ward U.S. Pat. No. 1,933,401, could be less desirably used.

In addition, while the cooled rolls are shown in the attached Figures and described herein in connection with the use of gas or jet wipers which determine the thickness of the final coating, it will be understood that any other suitable coating thickness determination means could be used.

In the claims appended hereto the term sheet is intended to include both sheet and strip as the case may be. It will also be realized that while the use of cooled rolls is shown on both sides of the sheet, if, in fact, it is important to have a minimized spangle on only one side of the strip, the cooled roll and or the use of the heat transfer liquid might be on only one side of the sheet.

We claim:

1. A method of producing galvanized ferrous strip having a minimized spangled coating on the surface thereof, comprising the steps of (a) passing said strip through a molten galvanizing bath to develop a molten coating layer on the surface of said strip, (b) contacting at least one coated surface of the strip with a cooled roll to nucleate said layer of the coating and cause rapid crystallization, and (c) providing a heat transfer liquid between the surface of said roll and the surface of the molten coating layer to provide even contact and heat transfer between the surface of the cooled roll and said coated surface.

2. A method in accordance with claim 1 wherein the heat transfer liquid is deposited on the roll surface and then distributed by means of a spreader to provide a thin even film of heat transfer liquid.

3. A method in accordance with claim 2 in which the heat transfer liquid is water.

4. A method in accordance with claim 3 in which the heat transfer liquid is cooled to a temperature near its freezing point prior to application to the cooled rolls.

5. A method in accordance with claim 3 in which two off-set unequal sized cooling rolls are used and the strip is wrap contacted with the surface of the rolls through the film of water and the heat transfer liquid is used on both sides of the strip.

* * * * *